United States Patent [19]

Lenthall

[11] 4,322,902

[45] Apr. 6, 1982

[54] INDICATORS FOR GARMENT HANGERS

[75] Inventor: Frank C. Lenthall, Frankston, Australia

[73] Assignee: F. L. Plastics Industries Pty. Ltd., Victoria, Australia

[21] Appl. No.: 30,527

[22] Filed: Apr. 16, 1979

[51] Int. Cl.[3] ..... G09F 3/00

[52] U.S. Cl. ..... 40/322; 40/301; 40/622

[58] Field of Search ..... 40/10 R, 301, 622, 322; 223/85, 92

[56] References Cited

U.S. PATENT DOCUMENTS

| | | | |
|---|---|---|---|
| 1,142,720 | 6/1915 | McAuley | 40/322 |
| 1,634,377 | 7/1927 | Montan et al. | 40/322 |
| 2,543,350 | 2/1951 | Bross | 40/322 X |
| 3,024,953 | 3/1962 | O'Keefe | 40/322 X |
| 3,685,189 | 8/1972 | Conger | 40/322 |
| 3,949,914 | 4/1976 | Ostroll | 40/322 |

FOREIGN PATENT DOCUMENTS

| | | | |
|---|---|---|---|
| 60873 | 3/1971 | Australia . | |
| 660527 | 11/1951 | United Kingdom | 40/322 |
| 1299986 | 12/1972 | United Kingdom | 40/322 |
| 1397413 | 6/1975 | United Kingdom | 40/322 |
| 1439985 | 6/1976 | United Kingdom | 40/322 |
| 1510479 | 5/1978 | United Kingdom | 40/322 |

*Primary Examiner*—Gene Mancene
*Assistant Examiner*—Wenceslao J. Contreras
*Attorney, Agent, or Firm*—Cushman, Darby & Cushman

[57] ABSTRACT

This specification discloses various indicators suitable for use in association with garment hangers for indicating the size or some other garment characteristic. In one embodiment the indicator comprises a molded body shaped to represent letters or numerals indicating the size of the garment and having a headed shank extending rearwardly therefrom, which shank is resiliently deformable to enable the shank to be inserted in and removed from a slot formed in the hanger. The indicator comprises a hollow four sided body in the shape of a trapezium, said body being adapted to engage a specially formed head on the hook of the hanger so as to be removably engaged thereon. The body is formed with cut out portions in the shape of letters or numbers indicating the size of the garment. The specification also discloses a garment hanger having means for supporting size indicators of the types described above.

16 Claims, 6 Drawing Figures

INDICATORS FOR GARMENT HANGERS

This invention relates to improvements in indicators for garment hangers.

It is most important in the retail display of garments on hangers that the customer be able to easily determine the size of the garment and/or the name of the manufacturer, or some other information about the garment. It is known to fit sizing indicators or tallies over the hooks of hangers and one such tally is described in Australian Pat. No. 459,115. While such tallies improve the availability of the size information to the customer, it is necessary to fit each tally by sliding it over the hook of the hanger. Furthermore, such tallies are not suitable for plastic hangers having hooks with large cross sections. Similarly, since such tallies rest on the shoulder of the hanger, they may not always be readily visible to the customer.

The invention therefore provides an indicator for a garment hanger, comprising a body portion formed to impart information regarding the size and/or manufacturer and/or retailer and/or some other garment characteristic, said body portion being formed with means for releasably attaching the indicator to a part of the hanger such that the indicator is visible when a garment is on the hanger.

In a preferred form of the invention, the body portion and/or attaching means are formed so that at least a portion of the indicator is visible from the rear of the hanger when the indicator is attached thereto.

In one embodiment, the indicator is in the form of a shaped hollow body adapted to engage part of the hook of the hanger, said body having a wide base and a relatively narrower top. Preferably, the hollow body is formed to interengage with the top portion of the hook of a hanger whereby the indicator is visible above the usual top contour of the hook.

In another aspect the invention provides a hanger adapted for use with an indicating device, said hanger being characterised by an enlarged display area attached to or forming part of the hanger and being visible when the garment is on the hanger, said display area being formed to detachably receive an indicating device which imparts information regarding the size and/or manufacturer and/or retailer and/or some other garment characteristics.

In a preferred form of this aspect, the enlarged display area is formed on the hook of the hanger, for example extending laterally from the hook or extending above the top of the hook.

In another aspect, the invention provides an indicator as defined above in combination with a hanger as defined above.

The invention will now be described with reference to the accompanying drawings, in which.

Figure 1:
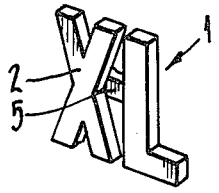
FIG. 1 is a front perspective view of an indicator according to one embodiment of the invention.
Figure 2:
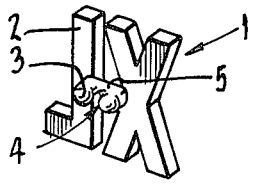
FIG. 2 is a rear perspective view of the indicator.
Figure 3:
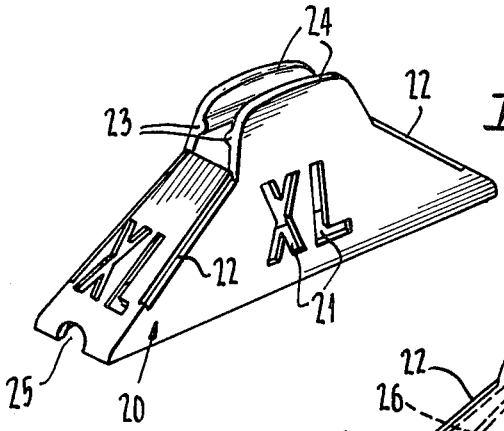
FIG. 3 is a front perspective view of an indicator according to the invention.

Referring firstly to FIGS. 1 and 2, the indicator comprises a body portion 1 which is moulded in the form of sizing letters or numbers 2, in the present case the letters XL indicating the size Extra Large, and a rearwardly extending headed projection 3 having a central cavity 4 which enables the head on the projection 3 to be resiliently deformed. The projection 3 has a shank portion 5 of rectangular cross-sectional configuration which extends between the sizing letters and is integrally moulded therewith so as to extend perpendicularly from the rear of the sizing letters 2.

Figure 4:
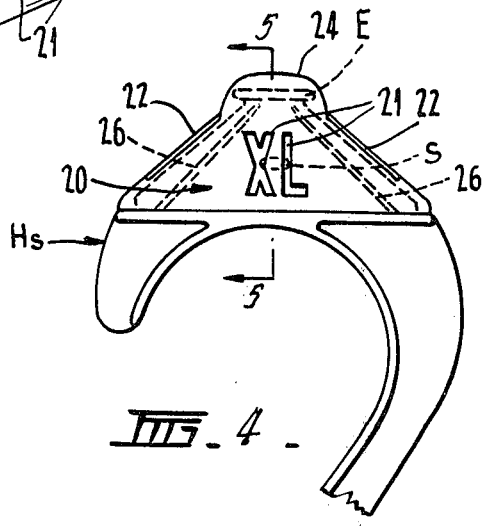
FIG. 4 shows the indicator of FIG. 3 in use on the specially designed hook of a hanger.
Figure 5:
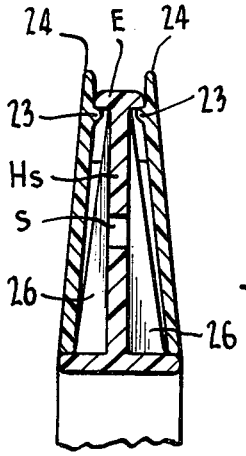
FIG. 5 is a sectional view taken along the line 5—5 in FIG. 15.

In the present embodiment, the shank 5 of the headed projection 3 serves two purposes: it securely interconnects the sizing letters 2 in an unobtrusive manner, and it serves to prevent rotation of the indicator when the headed projection 3 is inserted into a rectangular slot S formed in a shaped portion Hs provided on the hook of a garment hanger as shown in FIGS. 4 and 5.

The indicator body 1 and projection 3 are moulded from a colored plastic of any desired color coding corresponding to the size indicated by the indicator and since the headed projection 3 is visible from the rear of the hanger, the size of the garment can be readily determined even from the rear of the hanger.

The sizing letters or numbers 2 are preferably slightly wedge shaped to assist in the moulding of the letters or numbers. It will of course be appreciated that the letters shown in the drawings may be replaced by digits or by any other indicia means imparting some form of information to the customer. Several preferred sizing indicators are shown in our Australian Design Registrations Nos. 74,326 to 74,330 and 74,552.

The preferred indicator shown in FIGS. 3 to 6, comprises a moulded plastics four sided hollow body 20 with each side in the shape of a trapezium. The sides are each formed with a size indicating letters or numbers 21 which, in the embodiment shown, is in the form of a cut-out in the side, hot stamped, printed or otherwise applied to the indicator. In addition, the indicator is made from coloured plastics coded in accordance with the size number indicated thereon.

In the preferred embodiment shown, the indicator 20 is principally adapted for use with a hanger having a specially shaped head portion Hs adapted to receive the indicator 20 as shown. The shaped head portion Hs has an enlarged head E, which is larger in size than the opening in the top of the indicator 20. To enable the indicator 20 to be engaged with the shaped portion Hs, slits 22 are formed between the adjacent sides of the indicator 20 to allow the top opening to be expanded in size as the indicator 20 is forced over the enlarged head E. The sides of the indicator then snap back into a position in which beads 23 formed on the inside faces of the large sides engage under the enlarged head E and the indicator is securely retained in position on the hook. To assist in removal of the indicator 20 from the head E, the large sides are formed with upwardly projecting extensions 24 which may be gripped to spread the sides apart to disengage the beads 23 from the head E.

The angle of inclination of the small sides may vary from about 42° to 53° depending on the size of the head of the hanger while the angle of inclination of the large sides may vary between about 6° and 13°.

It will be self-evident from the drawings that the shaped head portion E has the same general configuration in side elevation as the internal configuration of the indicator 20 whereby the indicator is restrained against undesirable movement. In addition the shaped head E is provided with lateral webs 26 near each end thereof so as to inhibit movement of the indicator 20 in this direction.

It is preferred that the shaped head E be formed with a planar flat surface (not shown in the particular embodiment depicted in the drawings) which in use is arranged immediately behind the numbers 21. The color of the flat surface is desirably in contrast to the color of the indicator so as to provide a contrast therewith and enhance visibility of the numbers. In the embodiment depicted, which is less preferred, a slot S is provided suitable for receiving the headed projections of sizing indicators of the type shown in FIGS. 1 and 2. This enables the hanger formed in this manner to be used in either mode.

Where a hanger is not formed with a specially shaped head portion E, the indicator 20 may be used in an alternative mode to provide a size indication on the hanger. In this mode the indicator 20 is simply slipped over the end of the hook of the hanger and down the hook until the base of the indicator engages the shoulder of the hanger. Because the base is relatively wide in one dimension, and is at least nearly as wide or wider than most hangers in the other dimension, the indicator rests in a substantially stable manner on the shoulder of the hanger.

In certain cases, the hook of the hanger may be of such a width that the sides of the indicator must be spread apart during the fitting operation. When this situation occurs, the sides will grip the hook of the hanger quite firmly to further stabilize the position of the indicator on the hanger.

Figure 6:
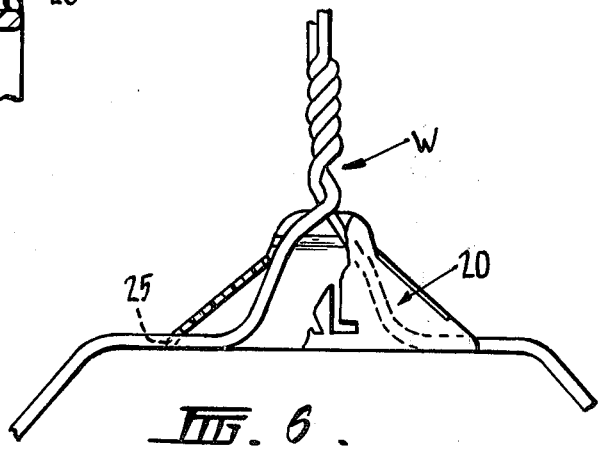
FIG. 6 is a partially sectional front elevation of the indicator of FIG. 3 in an alternative mode of use.

The small sides of the indicator 20 are preferably formed with semi-circular notches 25 to enable the indicator 20 to be positively located on the shoulder of a wire hanger W as shown in FIG. 6.

It should be appreciated that the indicator described above may be modified. For example the indicator may be formed in a truncated hollow conical configuration with several spaced slits extending from the small end of the indicator with the shaped head portion on the hook of the hanger is formed with an enlarged head as in the above embodiment.

In the present specification, the term "garment hanger" should be construed to include hangers for articles in general since the invention is by no means restricted to garment hangers.

It should also be appreciated that while the preferred form of the invention shown in FIGS. 1 and 2 is described in relation to sizing letters or numbers, the invention is equally applicable to single letters, such as L for large or single digits, such as size 8.

I claim:

1. In combination, a hanger for garments and other articles comprising:

a hook adapted to engage a rail or other supporting means, said hook having an enlarged display portion extending from the hook such that it projects above the top contour of the hook; and an indicating device attached to said display portion, said indicating device being readily visible when the hanger is in use by virtue of its position on said hook.

2. The hanger of claim 1, wherein said indicating device has a body portion formed with means for releasably attaching said body portion to said display area.

3. The hanger of claim 2, wherein said attaching means comprises a head shank being resiliently deformable to enable said shank to be inserted in and removed from a slot or other opening formed in said display area.

4. The hanger of claim 3, wherein the head on said shank is formed with a central cavity which divides the head into two separated portions which are resiliently deformable towards said central cavity.

5. The hanger of claim 2, wherein said body portion has two spaced parts imparting said information, said parts being securely interconnected by said attaching means.

6. The hanger of claim 5, wherein the spaced parts are moulded in the shape of numbers or letters and said attaching means extends between said numbers or letters at the rear of said numbers or letters whereby said attaching means does not substantially interfere with the information imparted to said numbers or letters.

7. The hanger of claim 6, wherein said letters or numbers are slightly wedge shaped to facilitate moulding from a plastics material.

8. In combination, a hanger for garments and other articles comprising:

a hook adapted to engage a rail or other supporting means, said hook having a supporting means extending from the hook such that it projects above the top contour of the hook; and an indicating device attached to said supporting means, said indicating device comprising a shaped body having a wide base and a narrower top, said body being formed with a cavity having an entrance opening within said wide base, said opening receiving said supporting means, said indicating device being readily visible from all directions when the hanger is in use by virtue of its position on said hook.

9. The hanger of claim 8 wherein said body has a plurality of spaced indicia, at least one of which is visible from the front of the hanger and at least another which is visible from the rear of the hanger.

10. The hanger of claim 8 wherein said indicating device comprises a hollow four-sided body with at least two opposed sides in the shape of a trapezium and slits between adjacent sides to allow the top of the body to be expanded in size.

11. The indicator of claim 10, wherein said indicia are formed by cut-outs extending through each of said sides to provide separate indicia visible from four different directions, said top portion having a number of substantially planar surfaces which, in use, are arranged behind said respective cut-outs, said planar surfaces being of contrasting color to said indicator whereby the visibility of said indicia is enhanced.

12. The hanger of claim 10 wherein all four sides are formed with indicia in the form of cut-out portions.

13. The hanger of claim 10 or 12 wherein the inclined sides of each trapezium shaped sides of said body have an angle of inclination between about 42 degrees and about 53 degrees.

14. The hanger of claim 13 wherein said indicating device has indicia indicating the size of the garment to be supported by the hanger.

15. The hanger of claim 13 wherein said indicating device is colored, said color being indicative of the size of the garment to be supported by the hanger.

16. A hanger for garments and other articles including a hook adapted to engage a rail or other supporting means, said hook having a display portion extending from the top portion of the hook such that it projects above the top contour of the hook, said display portion being formed with means for supporting a separately formed indicating device; and an indicating device engaged with or formed on said display portion, said indicating device being readily visible when the hanger is in use by virtue of its position on said hook, said indicating device including a hollow four-sided body with at least two opposed sides in the shape of a trapezium and slits between adjacent sides to allow the top of the body to be expanded in size wherein indicia in the form of cut-out portions extend through each of said sides to provide separate indicia visible from four different directions, said top portion having a number of substantially planar surfaces which in use are arranged behind respective cut-outs, said planar surfaces being of contrasting color to said indicator whereby the visibility of said indicia is enhanced.

* * * * *

US004322902B1

REEXAMINATION CERTIFICATE (2763th)

United States Patent [19] [11] B1 4,322,902

Lenthall [45] Certificate Issued Jan. 2, 1996

[54] INDICATORS FOR GARMENT HANGERS

[75] Inventor: Frank C. Lenthall, Frankston, Australia

[73] Assignee: Spotless Plastics Pty. Ltd., North Melbourne, Australia

Reexamination Request:
No. 90/003,580, Sep. 26, 1994

Reexamination Certificate for:

| | |
|---|---|
| Patent No.: | **4,322,902** |
| Issued: | **Apr. 6, 1982** |
| Appl. No.: | **30,527** |
| Filed: | **Apr. 16, 1979** |

[51] Int. Cl.[6] ..... G09F 3/00

[52] U.S. Cl. ..... 40/322; 40/301; 40/622; D6/328

[56] References Cited

U.S. PATENT DOCUMENTS

| | | |
|---|---|---|
| D. 192,845 | 5/1962 | Cohen . |
| D. 244,197 | 5/1977 | Ostroll . |
| 1,142,720 | 6/1915 | McAuley . |
| 1,634,377 | 7/1927 | Montan et al. . |
| 2,074,841 | 3/1937 | Haimowitz . |
| 2,099,596 | 11/1937 | Bruening . |
| 2,178,055 | 10/1939 | Stuppell . |
| 2,288,071 | 6/1942 | Cohen . |
| 2,543,350 | 2/1951 | Bross . |
| 2,658,627 | 11/1953 | Magnuson . |
| 2,864,147 | 12/1958 | Solow . |
| 3,024,953 | 3/1962 | O'Keefe . |
| 3,535,808 | 6/1968 | Morrish . |
| 3,685,189 | 8/1972 | Conger . |
| 3,731,857 | 5/1973 | Haggar . |
| 3,879,870 | 4/1975 | Bachand . |
| 3,949,914 | 4/1976 | Ostroll . |
| 4,045,899 | 9/1977 | Richardson . |
| 4,115,940 | 9/1978 | Phillips . |
| 4,137,661 | 2/1979 | Johansson . |
| 4,160,333 | 7/1979 | Indelicato . |
| 4,198,773 | 4/1980 | Batts et al. . |

FOREIGN PATENT DOCUMENTS

| | | |
|---|---|---|
| 140722 | 3/1949 | Australia . |
| 141875 | 4/1949 | Australia . |
| 163486 | 6/1955 | Australia . |
| 255815 | 3/1961 | Australia . |
| 287964 | 6/1965 | Australia . |
| 60537/69 | 9/1969 | Australia . |
| 60873/69 | 3/1971 | Australia . |
| 459115 | 9/1972 | Australia . |
| 70092 | 3/1977 | Australia . |
| 1095207 | 5/1955 | France . |
| 2765 | of 1893 | United Kingdom . |
| 660527 | 11/1951 | United Kingdom . |
| 1127937 | 9/1968 | United Kingdom . |
| 1151407 | 5/1969 | United Kingdom . |
| 1299986 | 12/1972 | United Kingdom . |
| 1397413 | 6/1975 | United Kingdom . |
| 1439985 | 6/1976 | United Kingdom . |
| 1510479 | 5/1978 | United Kingdom . |
| 1540371 | 2/1979 | United Kingdom . |

*Primary Examiner*—Brian K. Green

[57] ABSTRACT

This specification discloses various indicators suitable for use in association with garment hangers for indicating the size or some other garment characteristic. In one embodiment the indicator comprises a molded body shaped to represent letters or numerals indicating the size of the garment and having a headed shank extending rearwardly therefrom, which shank is resiliently deformable to enable the shank to be inserted in and removed from a slot formed in the hanger. The indicator comprises a hollow four sided body in the shape of a trapezium, said body being adapted to engage a specially formed head on the hook of the hanger so as to be removably engaged thereon. The body is formed with cut out portions in the shape of letters or numbers indicating the size of the garment. The specification also discloses a garment hanger having means for supporting size indicators of the types described above.

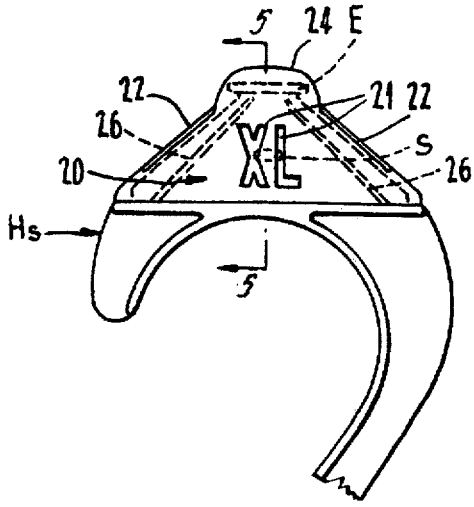

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 8–16 is confirmed.

Claim 5 is cancelled.

Claims 1–4 and 6 are determined to be patentable as amended.

Claim 7 dependent on an amended claim, is determined to be patentable.

New claims 17–20 are added and determined to be patentable.

1. In combination, a hanger for garments and other articles comprising:

a hook *having a top contour* adapted to engage a rail or other supporting means, said hook having an enlarged display portion extending from the hook such that it projects above the top contour of the hook; and an indicating device *having a hollow body* attached to said display portion, *wherein at least a part of the display portion is received within the hollow body of said indicating device; and* said indicating device being readily visible when the hanger is in use by virtue of its position on said hook.

2. The hanger of claim 1, wherein said indicating device has a body portion formed with means for releasably attaching said body portion to said display [area] *portion*.

3. [The hanger of claim 2,] *In combination, a molded plastic hanger for garments and other articles comprising:*

*a hook having a top contour adapted to engage a rail or other supporting means, said hook having an enlarged display portion extending from the hook such that it projects above the top contour of the hook; and*

*a molded plastic indicating device attached to said display portion, wherein said indicating device has a body portion formed with means for releasably attaching said body portion to said display portion,* wherein said attaching means comprises a head shank being resiliently deformable to enable said shank to be inserted in and removed from a slot or other opening formed in said display [area] *portion; said indicating device being readily visible when the hanger is in use by virtue of its position on said hook.*

4. The hanger of claim 3, [whererein] *wherein* the head [on said] shank is formed with a central cavity which divides the head *shank* into two separated portions which are resiliently deformable towards said central cavity.

6. The hanger of claim [5] *20*, wherein the spaced parts are moulded in the shape of numbers or letters and said attaching means extends between said numbers or letters at the rear of said numbers or letters whereby said attaching means does not substantially interfere with the information imparted to said numbers or letters.

*17. In combination, a molded plastic hanger for garments and other articles and a molded plastic indicating device, said combination comprising:*

*a hook having a top contour adapted to engage a rail or other supporting means, said hook having an integrally molded plastic flange which forms an enlarged display portion extending from the hook such that it projects above the top contour of the hook which engages said rail or other supporting means; and*

*said molded plastic indicating device which receives said molded plastic flange to attach said indicating device to said enlarged display portion, said indicating device being readily visible when the hanger is in use by virtue of its position on said hook.*

*18. In combination, a garment hanger and a color-coded size indicator which is readily visible when the hanger is in use, said combination comprising:*

*(a) a molded plastic garment hanger, said garment hanger having an integrally molded hook having a top contour to engage a rail or other supporting means;*

*(b) an enlarged display support integrally molded with said hook and extending upwardly from said hook above the top contour of the hook which engages said rail or other supporting means;*

*(c) a molded plastic size indicating device mounted on said enlarged display support, said device having a base and formed with a cavity defined within to receive said display support therewithin, said size indicating device being color coded and readily visible from all directions when the hanger is in use by virtue of its position on said hook; and*

*(d) means for releasably attaching said size indicating device to said enlarged display portion.*

*19. The hanger of claim 17, wherein said indicating device has a body portion formed with means for releasably attaching said body portion to said display portion.*

*20. In combination, a hanger for garments and other articles comprising:*

*a hook having a top contour adapted to engage a rail or other supporting means, said hook having an enlarged display portion extending from the hook such that it projects above the top contour of the hook; and an indicating device attached to said display portion, said indicating device being readily visible when the hanger is in use by virtue of its position on said hook, wherein said indicating device has a body portion formed with means for releasably attaching said body portion to said display portion, said body portion having two spaced parts imparting information, said parts being securely interconnected by said attaching means.*

* * * * *